US011299926B2

(12) United States Patent
Oakley et al.

(10) Patent No.: US 11,299,926 B2
(45) Date of Patent: Apr. 12, 2022

(54) DRIVE MECHANISM FOR IMPARTING MOVEMENTS TO A DOOR

(71) Applicant: MOTIONACCESS, LLC., Elk Grove Village, IL (US)

(72) Inventors: Robert L. Oakley, Chicago, IL (US); Joseph P. Madden, Des Plaines, IL (US)

(73) Assignee: MOTIONACCESS, LLC., Elk Grove Village, IL (US)

( * ) Notice: Subject to any disclaimer, the term of this patent is extended or adjusted under 35 U.S.C. 154(b) by 22 days.

(21) Appl. No.: 16/857,422

(22) Filed: Apr. 24, 2020

(65) Prior Publication Data

US 2020/0340283 A1 Oct. 29, 2020

Related U.S. Application Data

(60) Provisional application No. 62/838,911, filed on Apr. 25, 2019.

(51) Int. Cl.

| | |
|---|---|
| ***E05F 15/00*** | (2015.01) |
| ***E05F 15/611*** | (2015.01) |
| ***E05F 5/06*** | (2006.01) |

(52) U.S. Cl.

CPC ..... *E05F 15/611* (2015.01); *E05F 5/06* (2013.01); *E05Y 2201/11* (2013.01);

(Continued)

(58) Field of Classification Search

CPC . E05F 15/63; E05F 15/611; E05F 5/06; E05F 15/614; E05Y 2201/41;

(Continued)

(56) References Cited

U.S. PATENT DOCUMENTS 5,332,279 A * 7/1994 Golemis ..... B60J 5/0497 192/69.6

5,878,497 A * 3/1999 Seemann, III ..... B67B 7/0441 30/1.5

5,881,497 A * 3/1999 Borgardt ..... E05F 15/63 49/139

(Continued)

*Primary Examiner* — Chi Q Nguyen

(74) *Attorney, Agent, or Firm* — Law Office of John W. Harbst

(57) ABSTRACT

A drive mechanism for imparting movements to a door which pivots about a generally vertical axis between open and closed positions. The drive mechanism includes a frame, a power source mounted on the frame or positively driving an output shaft of the drive mechanism and thus, moving the door from a closed position toward an open position. The drive mechanism also includes an output shaft mounted for rotation about a fixed axis disposed generally parallel to a fixed axis of a power source drive shaft. A drive train including a plurality of intermeshing gear sets is arranged between the power source drive shaft and the output shaft. At least one gear set in the drive train includes a clutch mechanism selectively operable in either an engaged condition or a disengaged condition. When in a disengaged condition, the clutch mechanism operably transfers rotational movements of the power source to the output shaft so as to forcibly open the door. When operated in an engaged condition, the clutch mechanism operationally disconnect the power source and at least one gear set from the drive train thereby minimizing the manual effort required to open the door.

21 Claims, 5 Drawing Sheets

(52) U.S. Cl.
CPC ... *E05Y 2201/216* (2013.01); *E05Y 2201/224* (2013.01); *E05Y 2201/41* (2013.01); *E05Y 2201/422* (2013.01); *E05Y 2201/484* (2013.01); *E05Y 2201/706* (2013.01); *E05Y 2201/71* (2013.01); *E05Y 2600/452* (2013.01); *E05Y 2900/132* (2013.01)

(58) Field of Classification Search
CPC ..... E05Y 2201/71; E05Y 2201/214; E05Y 2201/686; E05Y 2201/422; E05Y 2201/216; E05Y 2201/706; E05Y 2201/624; E05Y 2600/12; E05Y 2800/298; E05Y 2800/33; E05Y 2900/132; E05Y 2201/718; E05Y 2201/72; E05Y 2201/11; E05Y 2600/452; E05Y 2800/11; E05Y 2201/484; E05Y 2201/224
USPC ..... 49/349, 506, 358; 16/49; 700/275
See application file for complete search history.

(56) References Cited

U.S. PATENT DOCUMENTS

| | | | | |
|---|---|---|---|---|
| 6,338,693 | B1 * | 1/2002 | Scholten | E05F 15/614 477/7 |
| 6,634,140 | B1 * | 10/2003 | Sellman | E05F 15/41 49/340 |
| 7,418,800 | B1 * | 9/2008 | Sellman | E05F 15/63 192/18 B |
| 8,405,337 | B2 * | 3/2013 | Gebhart | H02P 6/085 318/445 |
| 10,378,262 | B2 * | 8/2019 | Yulkowski | E05F 15/603 |
| 2002/0026750 | A1 * | 3/2002 | St. John | E05F 15/603 49/332 |
| 2011/0094160 | A1 * | 4/2011 | Houser | E05F 15/63 49/31 |
| 2011/0252597 | A1 * | 10/2011 | Burris | E05F 3/22 16/52 |
| 2016/0115725 | A1 * | 4/2016 | Yulkowski | E05F 15/70 49/70 |
| 2016/0273617 | A1 * | 9/2016 | Nickel | B60N 2/919 |

* cited by examiner

DRIVE MECHANISM FOR IMPARTING MOVEMENTS TO A DOOR

RELATED APPLICATION

This patent application is related to co-assigned and co-pending U.S. PROVISIONAL patent application Ser. No. 62/838,911, filed Apr. 25, 2019; the entirety of which is incorporated herein by reference.

FIELD OF THE INVENTION

This invention disclosure generally relates to a door which pivots between closed and open positions about a generally vertical axis and, more specifically, to a drive mechanism for moving a door from a closed position to an open position about a generally vertical axis.

BACKGROUND

Doors which swing about a vertical pivot axis as they move between closed and open positions are commonly used as an entryway door in any of a variety of different locations. In some situations, a door is known to pivotally move from a closed position toward an open position about an axis disposed toward a left side of the door. As such, these doors are commonly referred to as a "left-handed" door. In other situations, a door is known to pivotally move from a closed position toward an open position about an axis disposed toward a right side of the door. As such, these doors are commonly referred to as "right-handed" doors.

In some situations, and for a variety of different reasons, it is preferred for the door to be manually moved from a closed position to an open position. In many situations, however, and to ease accessability into a store, room or other suitable enclosure, such doors are operated between closed and open positions by a powered driver having a positively driven output shaft. The prior art has not and does not disclose a powered driver which can be selectively conditioned to allow either manual or powered operation of a door which pivots about a vertical axis between closed and open positions.

Thus, there is both a need and continuing desire for a drive mechanism which can be selectively conditioned to allow a door which pivots about a generally vertical axis to be moved between closed and open positions either manually or positively driven.

SUMMARY

In view of the above, and in accordance with one aspect of this invention disclosure, there is provided a drive mechanism for imparting movements to a door pivotal about a generally vertical axis between closed and open positions. The drive mechanism includes a frame or base for mounting the drive mechanism to a surface adjacent an axis about which the door pivots. A power source is mounted on the frame or base for positively driving an output shaft of the drive mechanism in one rotational direction. The power source includes a drive shaft rotatable about a fixed axis. The output shaft is mounted for rotation about a fixed axis disposed generally parallel to the fixed axis of the power source drive shaft. A drive train including a plurality of intermeshing gear sets is arranged between the power source drive shaft and the output shaft of the drive mechanism. At least one gear set in the drive train includes a manually operated clutch mechanism selectively operable in either an engaged condition or a disengaged condition. When in a disengaged condition, the clutch mechanism serves to operably connect and transfer rotational movements of the power source to the output shaft of the drive mechanism so as to forcibly open the door. When operated in an engaged condition, the clutch mechanism operably disconnects the power source and at least one gear set from the drive train thereby minimizing the manual effort required to open the door.

Preferably, the drive mechanism further includes a one-way clutch mechanism operably associated with one of the gear sets for restricting rotational movements of those gear sets upstream of that gear set having the one-way clutch operationally associated therewith. In a preferred form, the drive mechanism furthermore includes a torsion spring for forcibly rotating the gear sets in a direction opposite from the direction the drive power source rotates the gear sets.

Each gear set in the drive train preferably includes at least two gears arranged in intermeshing relationship with at least two other gears of an adjacent gear set. The relative diameters of the intermeshing gears on adjacent gear sets is such that a predetermined drive ratio is established between the power source drive shaft and the output shaft of the drive mechanism.

In one embodiment, the drive mechanism also includes an assembly for limiting the rotation of the output shaft of the drive mechanism. The assembly for limiting the rotation of the output shaft of the drive mechanism preferably includes a member which is rotatable with and follows one of the gears in the gear train and a stop connected to and carried by the frame or base.

According to another aspect of this invention disclosure, there is provided a drive mechanism for imparting opening movements to a door pivotal about a generally vertical axis. In this embodiment, the drive mechanism includes a frame or base for mounting the drive mechanism to a generally flat surface adjacent an axis about which the door pivots. A power source is mounted on the frame or base for positively driving an output shaft of the drive mechanism in a rotational direction suitable to open to the door. The power source includes a drive shaft rotatable about a fixed axis. The output shaft of the drive mechanism is mounted on and carried by the frame or base for rotation about a fixed axis disposed generally parallel to the fixed axis of power source drive shaft. A drive train including multiple intermeshing gear sets is arranged between the power source and the output shaft of the drive mechanism. In this embodiment, that gear set arranged adjacent the power source drive shaft includes a clutch mechanism selectively operable in either an engaged condition or a disengaged condition. When the clutch mechanism is in a disengaged condition, the clutch mechanism operably connects and transfers rotational movements of the power source drive shaft to the output shaft drive mechanism so as to positively open the door from a closed position. When the clutch mechanism is operable in an engaged condition, the clutch mechanism operationally disconnects the power source and the first gear set from the drive train thereby minimizing the manual effort required to manually open the door.

According to this aspect of the invention disclosure, the drive mechanism furthermore preferably includes a one-way clutch mechanism operably associated with one of the gear sets for restricting rotational movements of the gear set upstream of that gear set having the one-way clutch operatably associated therewith. In one form, the drive mechanism also includes a torsion spring for forcibly rotating the gear sets in a direction opposite from the direction the drive power source rotates the gear sets. In a preferred embodiment, the torsion spring is arranged in operable association with the output shaft of the drive mechanism.

Preferably, each gear set in the drive train includes at least two gears arranged in intermeshing relationship with at least two other gears of an adjacent gear se. The relative diameters of the intermeshing gears on adjacent gear sets is such that a predetermined drive ratio is established between the motor drive shaft and the output shaft of the drive mechanism.

The drive mechanism according to this aspect of the invention disclosure furthermore preferably includes an assembly for limiting the rotation of the output shaft of the drive mechanism. Such assembly for limiting the rotation of said output shaft of the drive mechanism preferably includes a member which rotates with and follows one of the gears and a stop carried by and connected to the frame or base.

According to another aspect of this invention disclosure, there is provided a drive mechanism for imparting opening movements to either a left-handed or right-handed door pivotal about a generally vertical axis. The drive mechanism includes a frame or base for mounting said drive mechanism to a generally flat surface adjacent an axis about which said door pivots. A drive power source is mounted on the frame or base. The drive power source includes a drive shaft rotatable about a fixed axis. An output shaft is mounted on and carried by the frame for rotation suitable to open to the door. The output shaft of the drive mechanism is mounted for rotation about a fixed axis disposed generally parallel to the fixed axis of the power source drive shaft. According to this aspect of the invention disclosure, opposed ends of the output shaft extend beyond opposed sides of the frame or base so as to allow the frame to be mounted in various orientations while maintaining access to the output shaft whereby allowing the drive mechanism to be used in operable combination with either left-handed or right-handed pivotal doors. A drive train, including multiple intermeshing gear sets, is arranged between the power source drive shaft and the output shaft of the drive mechanism. According to this aspect of the invention disclosure, the gear set arranged adjacent the power source drive shaft includes a clutch mechanism selectively operable in either an engaged condition or a disengaged condition. When in the disengaged condition, the clutch operably connects and transfers rotational movements of the power source drive shaft to the output shaft of the drive mechanism so as to positively open the door. When the clutch mechanism is in an engaged condition, the clutch mechanism effectively disconnects the power source and one of the gear sets in the drive train from output shaft of the drive mechanism to minimize manual force required to open the door.

In a preferred form, the drive mechanism further includes a one-way clutch mechanism operably associated with one of the gear sets so as to restrict rotational movements of the gear set upstream of the gear set having the one-way clutch operationally associated therewith. Preferably, the drive mechanism furthermore includes a torsion spring for forcibly rotating the gear sets in a direction opposite from the direction the drive power source rotates the gear sets. The torsion spring is preferably arranged in operable association with the output shaft of the drive mechanism.

Preferably, each gear set of the drive train includes at least two gears arranged in intermeshing relationship with at least two other gear, of an adjacent gear set. The relative diameters of the intermeshing gears on adjacent gear sets is such that a predetermined drive ratio is established by the drive train between the power source drive shaft and the output shaft of the drive mechanism.

In one form, the drive mechanism also includes an assembly for limiting the rotation of the output shaft of the drive mechanism. Preferably, the drive mechanism furthermore includes a cover extending about and enclosing the base or frame, the power source and the intermeshing gear sets while permitting access to opposed ends of the output shaft.

DETAILED DESCRIPTION OF THE DRAWINGS

DETAILED DESCRIPTION

Figure 1:
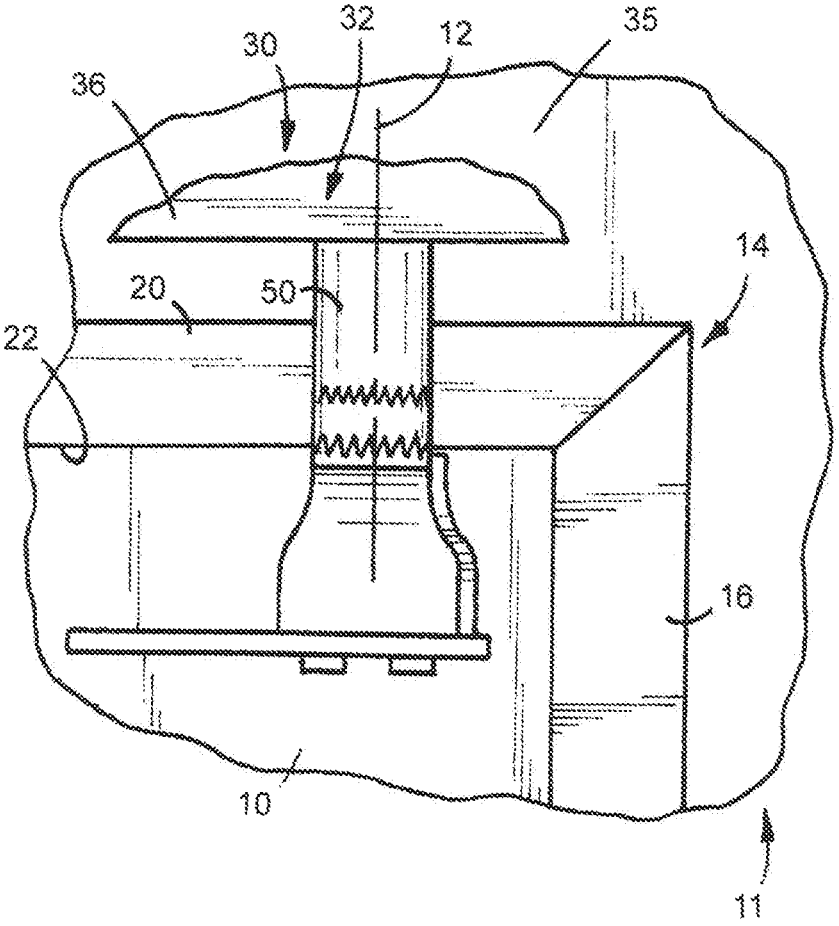
FIG. 1 is an elevational view illustrating one arrangement of a drive mechanism embodying principals and teachings of this invention disclosure in operable combination with a door which pivots about a generally vertical axis.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, there is shown in FIG. 1 one example of a pivotal door and a fragmentary showing of a mechanism for imparting movements to such pivotal door. In the embodiment illustrated by way of example in FIG. 1, a door 10 is mounted for pivotal movement between open and closed positions to allow ingress and egress from a building, a walled room or other suitable space, generally indicated by reference numeral 11.

In FIG. 1, door 10 is schematically illustrated for pivotal movements about a generally vertical and stationary axis 12. The door 10 moves within and respect to a frame or base 14 having upstanding side frame members 16 (with only one being shown) which are rigidly joined to each other by a header or top frame member 20. The frame members of the frame or base 14 combine to define an opening 22 allowing access to and from a building, room, etc. 11.

In the embodiment illustrated by way of example in 1G. 1, the door 10 swings or pivots about axis 12 disposed toward a right side or edge of the door 10. As such, in the embodiment illustrated by way of example in FIG. 1, door 10 is commonly referred to as a "right-handed door". Moreover, in the embodiment illustrated by way of example in FIG. 1, the door 10 swings or pivots about axis 12 and toward an interior of room.

A door operating system, generally identified by reference numeral 30, is operably connected to the door 10. The operating system 30 serves to move the door 10 about axis 12 between closed and open positions. In the arrangement illustrated, the door operating system 30 includes a drive mechanism 32 (FIG. 2) for selectively imparting movements to door 10 (FIG. 1). In the embodiment illustrated in FIG. 2, drive mechanism 32 includes a rigid frame or base 34. The base or fame 34 is so designed and configured to permit mounting and securing the drive mechanism 32 to a generally flat surface 35 adjacent the door frame 14 above the door 10 and typically proximate or adjacent to the axis 12 (FIG. 1) about which the door 10 pivots as door 10 moves from a closed position toward an open position. Notably, the drive mechanism 32 is uniquely designed and configured such that it can be suitably mounted either to an interior or exterior side of the door 10. As illustrated by way of example in FIGS. 1 and 2, a releasable cover 36 preferably carried by and extends about the frame 34 to enclose the entirety of the drive mechanism 32 and related parts thereof including the frame or base 34.

Figure 2:
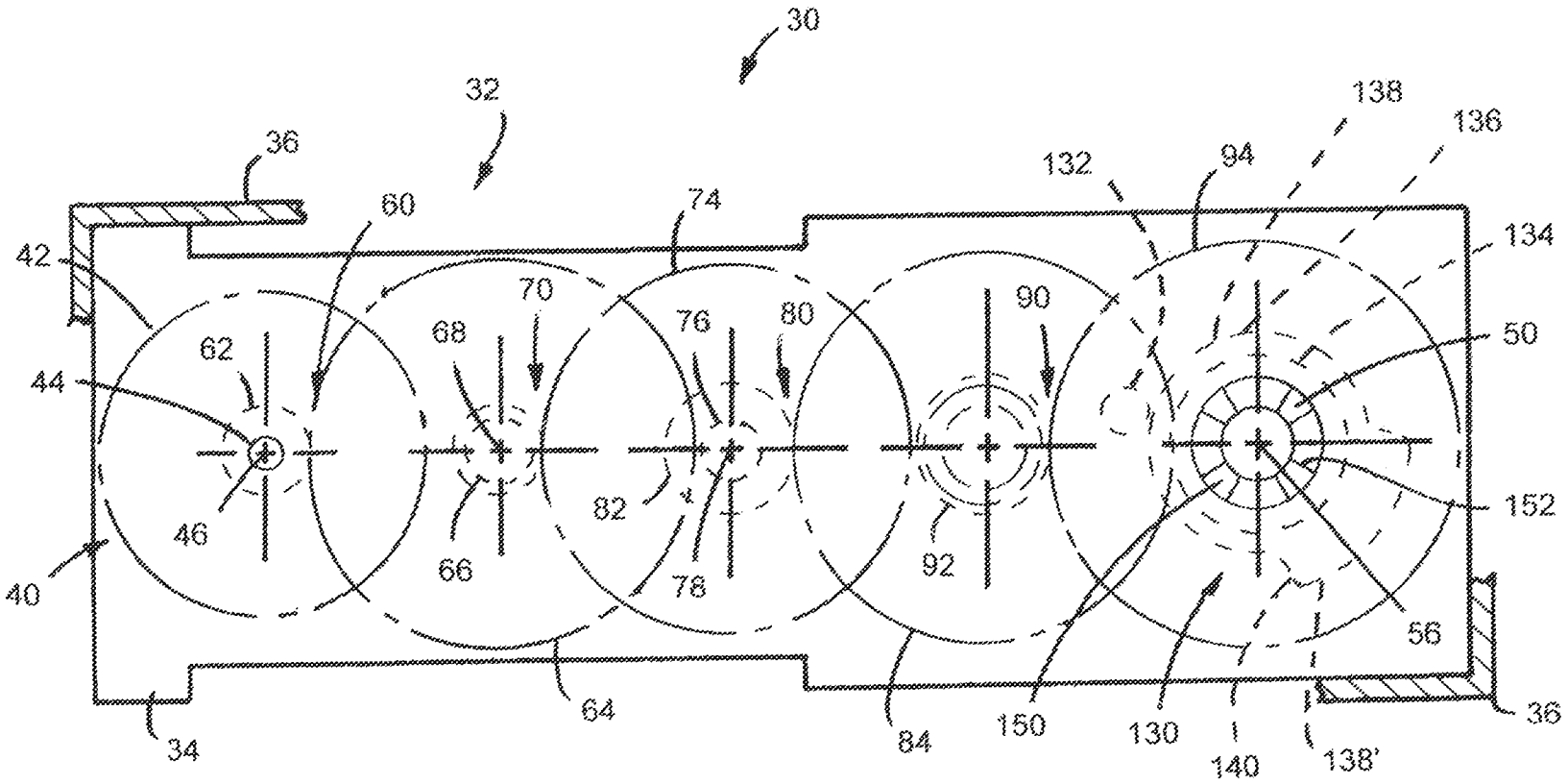
FIG. 2 is a schematic side elevational view of one form of a drive mechanism embodying principals and teachings of this invention disclosure.
Figure 3:
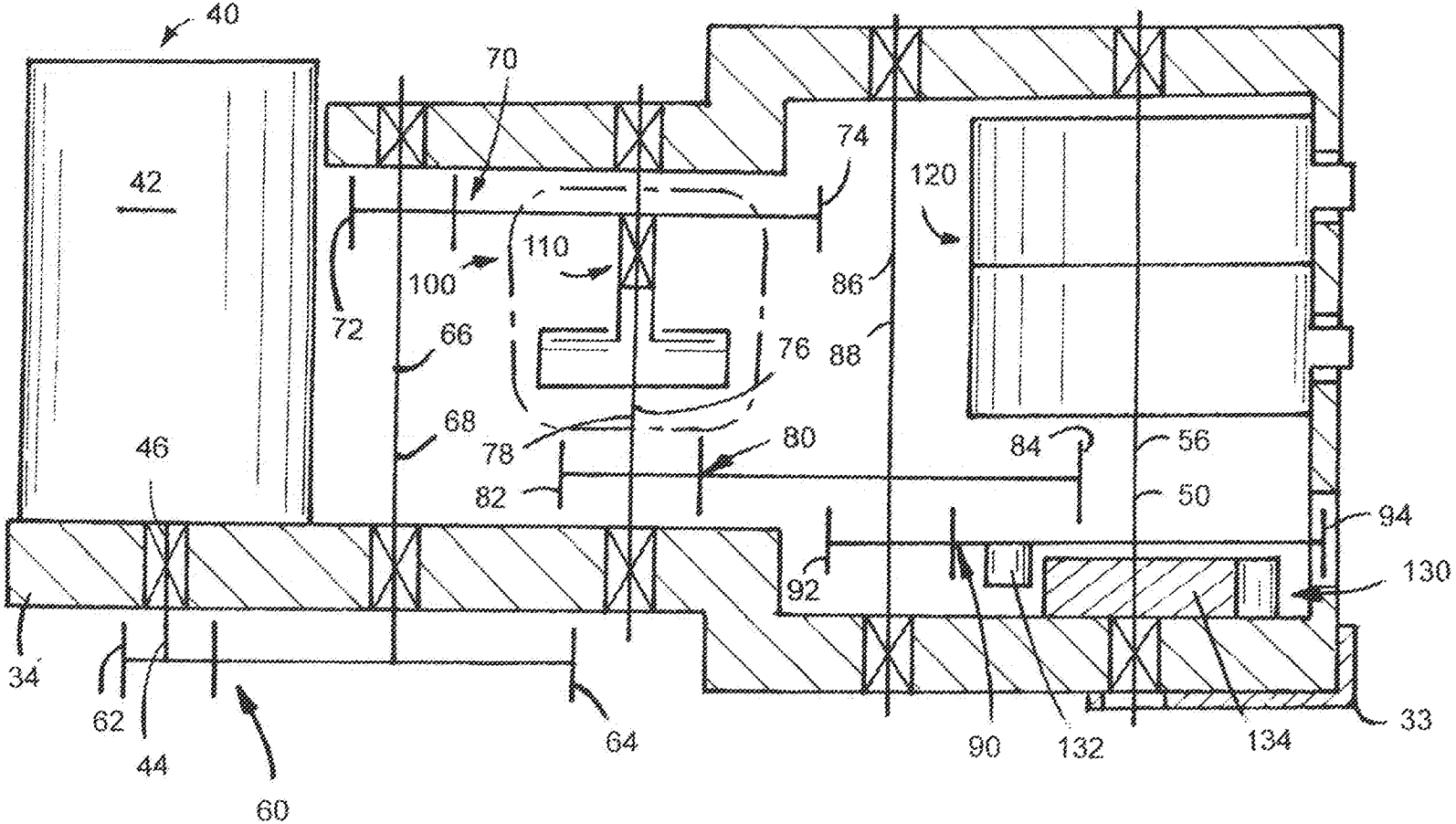
FIG. 3 is a schematic top plan view of the drive mechanism illustrated in FIG. 2.

As illustrated in FIGS. 2 and 3, a suitable power source 40 is mounted on frame 34. The power source 40 can be of any of a variety of types but preferably includes an electrically driven motor 42 of the type sold by Pandico Technology Co., Ltd. located in Taipei, Taiwan under Model No. SY-22022; or equivalents thereof. Suffice it to say, the power source 40 includes a driven shaft 44 that is journaled by base or frame 34 and rotates about a fixed axis 46.

As illustrated in FIGS. 2 and 3, a suitable power source 40 is mounted on frame 34. The power source 40 can be of any of a variety of types but preferably includes an electrically driven motor 42 of the type sold by Pandico Technology Co., Ltd. located in Taipei, Taiwan under Model No. SY-22022; or equivalents thereof. Suffice it to say, the power source 40 includes a driven shaft 44 that is journalled by frame 34 and rotates about a fixed axis 46.

Drive mechanism 32 further includes an output shaft 50 which is suitably journalled by frame 32 for rotation about a fixed axis 56 disposed in spaced relation from the fixed axis 46 of the power source 40. Notably, the fixed axis 46 of the drive shaft 44 of power source 40 and the fixed axis 56 of the output shaft 50 extend generally parallel relative to each other. In a preferred embodiment, free and opposed ends of the drive shaft 50 extend beyond the housing 36 to readily allow access thereto.

A drive train including plurality of intermeshing gear sets 60, 70, 80 and 90 is arranged between the drive shaft 44 of the power source 40 and the output shaft 50 of drive mechanism 32. Applicants appreciate and understand the arrangement of the drive train and the plurality of intermeshing gear sets 60, 70, 80 and 90 for transferring rotation between the power source 40 and output shaft 50 can be different from that illustrated for exemplary purposes without detracting or departing from the spirit and scope of this invention disclosure. Moreover, Applicants appreciate a greater or lesser number of intermeshing gear sets from that illustrated by way of example in FIGS. 2 and 3, could be used between the drive shaft 44 of the power source 40 and the output shaft 50 of drive mechanism 32 to effect the desired ends of transferring rotational power and movements therebetween without detracting or departing from the novel sprit and broad scope of this invention disclosure. The relative diameters of the intermeshing preferably metal or steel gears on adjacent gear sets is such that a predetermined drive ratio is established between the drive shaft 44 of the power source 40 and the output shaft 50 of the drive mechanism 32.

In the embodiment further illustrated by way of example in FIGS. 2 and 3, gear set 60 includes at least two intermeshing gears 62 and 64 for transferring rotation from the power source 40. More specifically, in the embodiment illustrated by way of example in FIGS. 2 and 3, gear set 60 includes a first gear 62 which intermeshes with a second gear 64 such that the gear set 60 establishes and maintains a predetermined gear ratio therebetween. In the illustrated embodiment, gear 62 is suitably fastened to rotate with the driven shaft 44 of the power source 40. In the illustrated embodiment, gear 64 is fastened to and rotates with a shaft 66 whose opposed ends are suitably journalled by frame 34. Preferably, shat 66 defines an axis 68 which extends generally parallel to the fixed axis 46 of the drive shaft 44 of power source 40 and the fixed axis 56 of the output shaft 50 of mechanism 32.

In the embodiment illustrated by way of example in FIGS. 2 and 3, gear set 70 includes at least two intermeshing gears 72 and 74 for transferring rotation downstream from gear set 60. More specifically, in the embodiment illustrated by way of example in FIGS. 2 and 3, gear set 70 includes a first gear 72 which intermeshes with a second gear 74 such that the gear set 70 establishes and maintains a predetermined gear ratio therebetween. In the illustrated embodiment, gear 72 is suitably fastened to rotate with the driven shaft 66. In the illustrated embodiment, gear 74 is arranged to selectively rotate with a shalt 76 whose opposed ends are suitably journalled by frame 34. Preferably, shalt 76 defines an axis 78 which extends generally parallel to the fixed axis 46 of the drive shaft 44 of power source 40, the fixed axis 68 of shaft 66, and the fixed axis 56 of the output shaft 50 of mechanism 32.

In the embodiment shown by way of example in FIGS. 2 and 3, gear set 80 includes at least two intermeshing gears 82 and 84 (or transferring rotation downstream from gear set 70. More specifically, in the embodiment shown by way of example in FIGS. 2 and 3, gear set 80 includes a first gear 82 which intermeshes with a second gear 84 such that the gear set 80 establishes and maintains a predetermined gear ratio therebetween. Preferably, gear 82 is suitably fastened to rotate with shaft 76 while gear 84 is fastened to and rotates with a shaft 86 whose opposed ends are suitably journalled by frame 34. Preferably, shaft 86 defines an axis 88 which extends generally parallel to the fixed axis 46 of the drive shah 44 of power source 40, the fixed axis 68 of shaft 66, the fixed axis 78, and the fixed axis 56 of the output shaft 50 of mechanism 32.

In the embodiment illustrated by way of example in FIGS. 2 and 3, gear set 90 includes at least two intermeshing gears 92 and 94 for transferring rotation from gear set 80 to the output shaft 50 of mechanism 32 in the embodiment illustrated by way of example in FIGS. 2 and 3, gear set 90 includes a first gear 92 which intermeshes with a second gear 94 such that the gear set 90 establishes and maintains a predetermined gear ratio therebetween. In the illustrated embodiment, gear 92 is suitably fastened to rotate with the driven shaft 86 of gear set 80. In the illustrated embodiment, gear 94 is preferably fastened to, rotates with and drives the output shaft 50 of the drive mechanism 32.

The drive mechanism 32 of this invention disclosure is uniquely designed to allow the door 10 (FIG. 1) to be moved either with assistance or simply moved manually. To effect these desired ends, and in the embodiment schematically illustrated in FIG. 3, the drive mechanism 32 furthermore includes a manually operated clutch mechanism 100 operable in combination with at least one gear set 60, 70, 80 or 90 in the drive train of the drive mechanism 32. In the preferred embodiment illustrated by way of example in FIG. 3, clutch mechanism 100 is preferably arranged in operable combination with gear 74 of gear set 70; that is gear set preferably arranged adjacent to the power source 40.

Clutch mechanism 100 is selectively operable in either an engaged condition or a disengaged condition. In a disengaged condition, clutch mechanism 100 operably connects and transfers rotational movements of the drive shaft 44 of drive motor 42 to the output shaft 50 of drive mechanism 32 so as to drive or propel the door 10 (FIG. 1) toward an open position. In an engaged condition, the clutch mechanism 100 operatably and effectively disconnects the drive motor 42 of power source 40 and at least one gear set from the drive train thereby minimizing the manual effort required to open the door 10 (FIG. 1). Notably, when clutch mechanism 100 is in an engaged condition, the power source 40 is effectively disconnected from the door 10 (FIG. 1). As such, and as door 10 moves toward an open position, the inner workings inherent with power source 40 along with that portion of gear train including the gears 62, 64 and 72, 74 associated with gear sets 60 and 70 are not required to turn or rotate thereby lessening the power and energy required to move the door 10 (FIG. 1).

Figure 4:
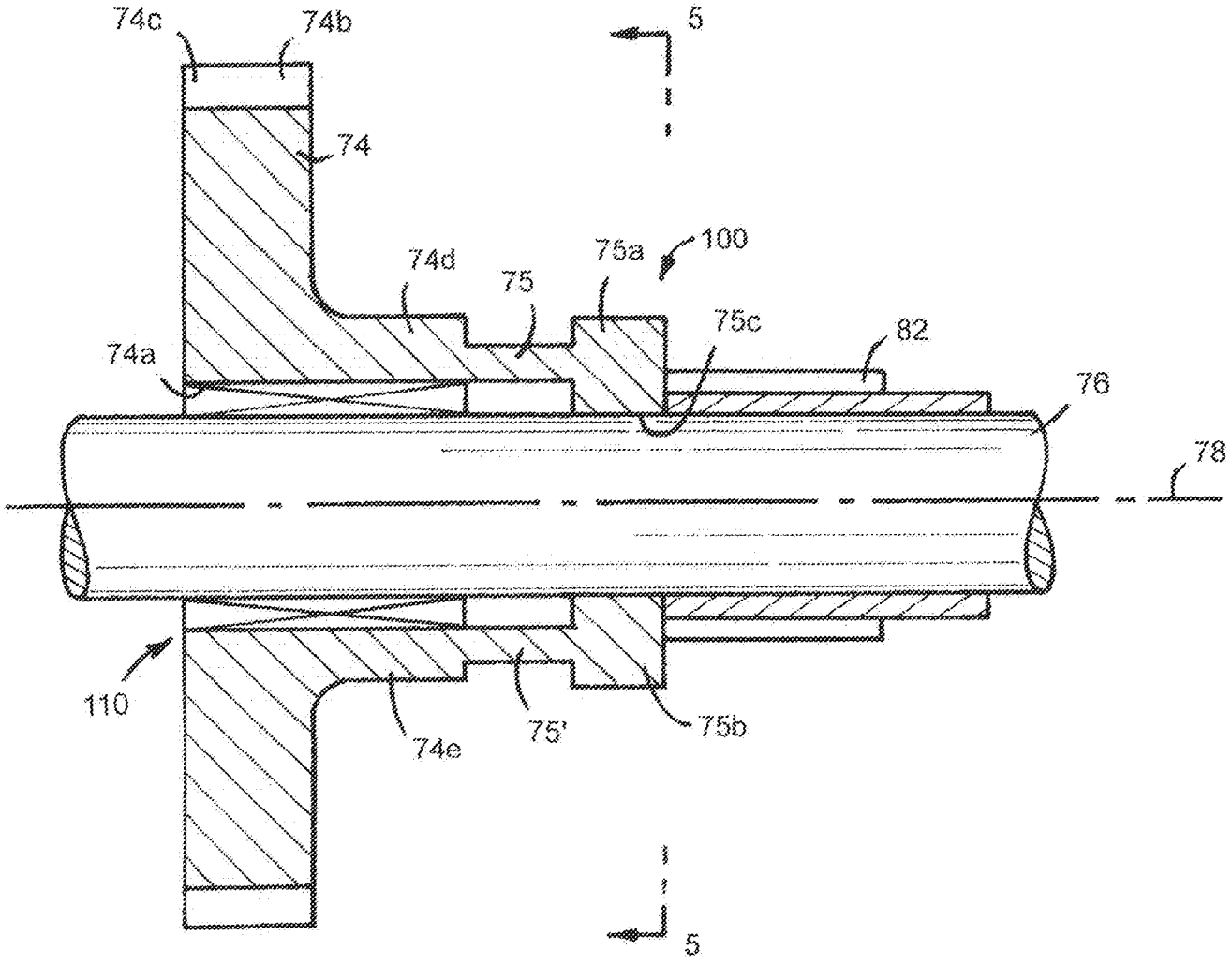
FIG. 4 is an enlarged cross-sectional view of a clutch mechanism forming part of the drive mechanism of this invention disclosure.

As will be appreciated by those skilled in the art, clutch mechanism 100 can take any of a myriad of different designs and configurations without detracting or departing from the broad spirit and novel scope of the present invention. In the embodiment illustrated by way of example in FIG. 4, clutch mechanism 100 is preferably formed an integral part of gear 74. That is, gear 74 defines a centralized bore 74*a* for allowing gear 74 to be coaxially arranged about while allowing shall 76 to extend endwise therethrough. In the illustrated embodiment, gear 74 includes a gear portion 74*b* with appropriately formed teeth 74*c* extending about a periphery thereof and a hub portion 74*d* axially extending from a central region 74*e* of gear portion 74*b* of gear 74. Clutch mechanism 100 further includes a pair of arm segments or portions 75 and 75'(FIG. 5) axially extending from the hub portion 74*d* on diametrically opposed sides of the axis 78 of shaft 76 (FIG. 5).

While being rigidly joined to and movable with the hub portion 74*d* of gear 74, the preferable design of each arm segment or portion 75, 75' advantageously permits a degree of flexure to a pair of preferably semicircular and divided clamping jaws 75*a* and 75*b* carried at and connected to the distal ends of arm segments or portions 75 and 75'. As shown in FIG. 5, the semicircular clamping jaws 75*a* and 75*b* combine with each other to define a bore 75*c* therebetween.

Figure 5:
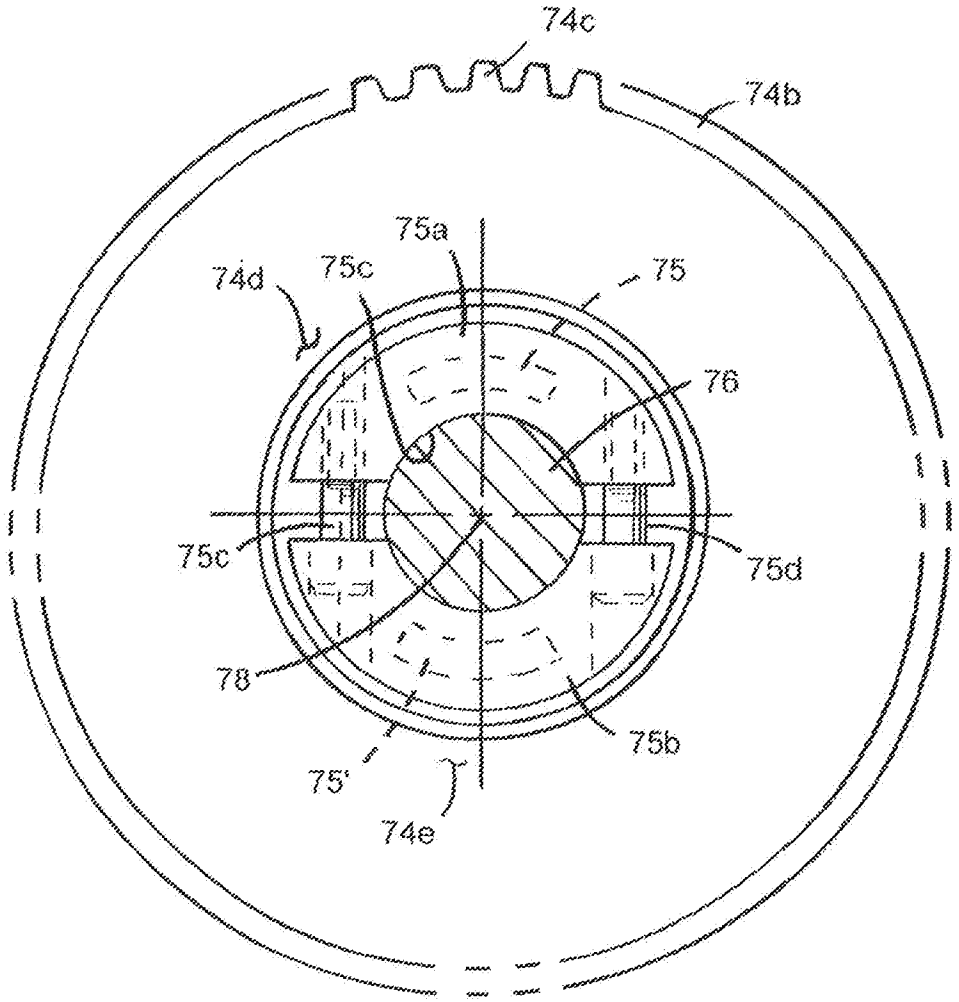
FIG. 5 is a cross-sectional view taken along line 5-5 of FIG. 4.

In the embodiment illustrated by way of example in FIG. 5, the clamping jaws 75*a* and 75*h* are divided or separated from each other by a relatively narrow slit 75*c* extending outwardly from the marginal edge of the bore 75*c* to the exterior of the clamping jaws 75*a* and 74*b*. The bore 75*c* defined between the clamping jaws 75*a* and 75*b* has an inner diameter which is slightly greater than the outer diameter of the shaft 76 extending or pass in g endwise therethrough so as to permit shaft 76 to freely rotate relative to gear 74.

Moreover, clutch mechanism 100 preferably includes a pair of fasteners 75*d* and 75*e*. To selectively condition the clutch mechanism 100 in an engaged condition, the fasteners 75*d* and 75*e* are simply tightened whereby moving the clamping jaws 75*a* and 75*b* to selectively apply a clamping force about the outer diameter of shaft 76 (FIG. 5). As will be understood, when the clutch mechanism 100 is operated in the engaged condition, gear 74 is operably joined to shaft 76.

As will be further understood, when clutch mechanism 100 is selectively operated in a non-engaged condition, the fasteners 75*d* and 75*e* are selectively loosened and the clamping force of the clamping jaws 75*a* and 75*b* on shaft 76 is released through the flexure of the arm segments or portions 75 and 75'. That is, in the non-engaged condition, shaft 76 is allowed to freely turn and rotate relative to gear 74. As such, and when the clutch mechanism 100 is selectively operated in a non-engaged or disengaged condition no rotational movements are transferred between gear set 60 and gear set 70.

Preferably, the drive mechanism 32 of the present invention disclosure furthermore includes a one-way clutch mechanism 110 operably associated with gear 74 of gear set 70 for restricting rotational movement of the gear set 60 disposed upstream of gear set 70 when clutch mechanism 100 is selectively operated in a non-engaged or disengaged condition. The one-way clutch mechanism 110 is preferably of a conventional design and can be a KOYO shell type sold by JTETK Corporation of Arlington Heights, Ill. under Model No. RCB-101416.

Returning to FIG. 2, the drive mechanism 32 of the present invention disclosure furthermore preferably includes an appropriately sized, conventional and generally circularly wound torsion spring 120. In one form, one end of spring 120 is operably connected to the output shaft 50 of drive mechanism 32 while another end of spring 120 is held stationary to the frame 34. As will be appreciated from an understanding of the operation of drive mechanism 32, the torsion spring 120 stores torque and mechanical energy and tightens about shaft 50 in response to the power source 40 imparting rotational movements to drive mechanism 32 to move the door (FIG. 1) toward an open position. After door 10 (FIG. 1) has been moved toward an open position and the power source 40 no longer inputs energy to the drive mechanism 32, spring 120 automatically unwinds and uses the stored energy therewithin to forcibly rotate the gear sets 60, 70, 80 and 90 of the drive train in a direction opposite from the direction the gear sets 60, 70, 80 and 90 are moved under the influence of the power source 40 so as to return the door 10 (FIG. 1) toward a closed position.

In a preferred embodiment illustrated in FIGS. 2 and 3, drive mechanism 32 furthermore includes an assembly 130 for limiting rotation of the output shaft 50 of drive mechanism 32. As will be readily appreciated, assembly 130 can take any of several different designs and features for limiting the rotational movements of the output shaft 50 without detracting or departing from true spirit and novel concept of this invention disclosure.

In the embodiment illustrated for exemplary purposes in FIGS. 2 and 3, limiting assembly 130 includes a member 132 which moves with and extends laterally outward from gear 94. In the embodiment illustrated for exemplary purposes in FIGS. 2 and 3, assembly 130 also includes a stop 134 secured to frame 32 for limiting movement of member 132 therepast as the door (FIG. 1) moves from the closed position toward an open position. As shown in FIG. 2, stop 134 preferably includes a peripheral face 136 significant portions of which are identified by reference numerals 138 and 138'.

As the drive mechanism 32 is operated to move the door 10 (FIG. 1) toward an open position, gear 94 rotates in a counterclockwise direction as viewed in FIG. 2. As will be appreciated from FIG. 2, the range of movement of gear 94 continues until the member 132, carried by and movable with gear 94, engages or contacts a radial shoulder 140 on stop 134 defined between the peripheral surfaces 138 and 138' on the peripheral face 136 of stop 134. As such, further rotation of gear 94 and, thus, output shaft 50 of drive mechanism 32 is stopped or halted by the abutting relationship of member 132 with stop 134.

In the embodiment shown by way of example in FIG. 2, each end of the output shaft 50 (with only one being shown) includes an end face 150 disposed generally perpendicular to the axis 56 of shaft 50. Notably, the end faces 150 at opposed ends of the output shaft 50 extend past the housing 36 and are each accessible from either side of the drive mechanism 32. As such, mounting of the drive mechanism 32 can advantageously be reversed such that the same drive mechanism can be used to open either a left-handed door or a right-handed door. Moreover, each end face 150 of the output shaft 50 preferably has a series of radially spaced serrations 152 thereon for enhancing engagement of the output shaft 50 with other drive components i.e., drive components for the door 10 (FIG. 1) arranged downstream of the output shaft 50 when desired.

Thus, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated and described. Rather, this disclosure is intended to cover by the appended claims all such modifications and variations as fall within the spirit and scope of the claims.

What is claimed is:

1. A drive mechanism for imparting movements to a door mounted in a frame and pivotal about a generally vertical axis between open and closed positions, said drive mechanism comprising:

a base for mounting said drive mechanism to a surface on said frame adjacent said generally vertical axis about which said door pivots;

a power source mounted on said base for positively driving an output shaft of said drive mechanism in one rotational direction, with said power source including a drive shaft rotatable about a fixed axis, and with said output shaft being mounted on said base for rotation about a fixed axis disposed generally parallel to the fixed axis of the drive shaft of said power source;

a drive train including a plurality of intermeshing gear sets arranged between the drive shaft of said power source and said output shaft of said drive mechanism, with a first gear set in said drive train including at least two gears arranged in intermeshing relationship with at least two other gears of a second adjacent gear set and a clutch mechanism arranged in operable combination with one of said first or second gear sets, with said clutch mechanism being selectively operable in either an engaged condition or a disengaged condition, with said clutch mechanism, when in said disengaged condition, serving to operably connect and transfer rotational movements of the power source drive shaft to said output shaft of said drive mechanism so as to open said door, and, when said clutch mechanism is in an engaged condition, said clutch mechanism operably disconnects the power source and at least one gear set in said drive train from the output shaft of said drive mechanism whereby minimizing manual force required to open said door.

2. The drive mechanism according to claim 1, further including a one-way clutch mechanism operably associated with a gear of one of said gear sets for restricting rotational movements of those gear sets upstream of that gear set having said one-way clutch operationally associated therewith.

3. The drive mechanism according to claim 1, further including a spring for forcibly rotating the gear sets in a direction opposite from the direction the power source rotates the gear sets.

4. The drive mechanism according to claim 1, wherein the relative diameters of the intermeshing gears on adjacent gear sets of said gear train is such that a predetermined drive ratio is established between the drive shaft of said power source and the output shaft of said drive mechanism.

5. The drive mechanism according to claim 4, further including an assembly for limiting the rotation of said output shaft of said drive mechanism.

6. The drive mechanism according to claim 5, wherein said assembly for limiting the rotation of said output shaft of said drive mechanism includes a member which is rotatable with and follows one of said gears and a stop carried by said base.

7. A drive mechanism for imparting opening movements to a door mounted in a frame and pivotal about a generally vertical axis, said drive mechanism comprising:

a base for mounting said drive mechanism to a generally flat surface adjacent said generally vertical axis about which said door pivots;

a power source mounted on said base for positively driving an output shaft of said drive mechanism in a rotational direction suitable to open said door, with said power source including a drive shaft rotatable about a fixed axis, and with said output shaft being mounted on said base for rotation about a fixed axis disposed generally parallel to the fixed axis of the drive shaft of said power source;

a drive train including multiple intermeshing gear sets arranged between the drive shaft of said power source and said output shaft, with a first gear set being arranged adjacent the drive shaft of said power source and includes at least two gears arranged in intermeshing relation with at least two other gears of a second adjacent gear set, and a clutch mechanism arranged in operable combination with said first or second gear set and selectively operable in either an engaged condition or a disengaged condition, with said clutch mechanism, when in said disengaged condition, serving to operably connect and transfer rotational movements of the power source drive shaft to said output shaft so as to open said door, and, when said clutch mechanism is in an engaged condition, said clutch mechanism operably disconnects the power source and at least one gear set in the drive train from the output shaft whereby minimizing the force required to open said door.

8. The drive mechanism according to claim 7, further including a one-way clutch mechanism operably associated with a gear of one of said gear sets in said gear train for restricting rotational movements of the gear set upstream of that gear set having said one-way clutch mechanism operationally associated therewith.

9. The drive mechanism according to claim 7, further including a torsion spring for forcibly rotating the gear sets in a direction opposite from the direction the power source rotates the gear sets.

10. The drive mechanism according to claim 9, wherein said torsion spring is arranged in operable association with the output shaft of said drive mechanism.

11. The drive mechanism according to claim 7, wherein the relative diameters of the intermeshing gears on adjacent gear sets in the gear train is such that a predetermined drive ratio is established between the drive shaft of said power source and the output shaft of said drive mechanism.

12. The drive mechanism according to claim 11, further including an assembly for limiting the rotation of said output shaft of said drive mechanism.

13. The drive mechanism according to claim 12, wherein said assembly for limiting the rotation of said output shaft of said drive mechanism further includes a member which is rotatable with and follows one of said gears and a stop carried by said base.

14. A drive mechanism for imparting opening movements to either a left-handed or right-handed door mounted in a frame for pivotal movements about a generally vertical axis, said drive mechanism comprising:

a base for mounting said drive mechanism to a generally flat surface on said frame adjacent said generally vertical axis about which said door pivots;

a power source mounted on said base, with said power source including a drive shaft rotatable about a fixed axis;

an output shaft mounted on said base for rotation suitable to open said door, and with said output shaft being mounted for rotation about a fixed axis disposed generally parallel to the fixed axis of the drive shaft of said power source, with opposed ends of said output shaft extending to opposed sides of said base so as to allow said base to be mounted in various orientations while maintaining access to the output shaft whereby allowing said drive mechanism to be used in operable combination with either left-handed or right-handed pivotal doors;

a gear train including multiple intermeshing gear sets arranged between the drive shaft of said power source and said output shaft, with a first gear set including at least two gears arranged in intermeshing relation with at least two other gears of a second adjacent gear set, and a clutch mechanism arranged in operable combination with said first or second gear sets and is selectively operable in either an engaged condition or a disengaged condition, with said clutch mechanism, when in said disengaged condition, serving to operably connect and transfer rotational movements of the power source drive shaft to said output shaft so as to open said door, and, when said clutch mechanism is in an engaged condition, said clutch mechanism effectively disconnects the power source and at least one gear set in the gear train from the output shaft so as to minimize manual effort required to open said door.

15. The drive mechanism according to claim 14, further including a one-way clutch mechanism operably associated with a gear of said first or second gear sets for restricting rotational movements of the gear set upstream of that gear set having said one-way clutch mechanism operationally associated therewith.

16. The drive mechanism according to claim 14, further including a torsion spring for forcibly rotating the gear sets in a direction opposite from the direction the power source rotates the gear sets.

17. The drive mechanism according to claim 16, wherein said torsion spring is arranged in operable association with the output shaft of said drive mechanism.

18. The drive mechanism according to claim 14, wherein the relative diameters of the intermeshing gears on adjacent gear sets in the gear train is such that a predetermined drive ratio is established between the drive shaft of said power source and the output shaft of said drive mechanism.

19. The drive mechanism according to claim 14, further including an assembly for limiting the rotation of said output shaft of said drive mechanism.

20. The drive mechanism according to claim 14, wherein opposed ends of the output shaft each has an end face, and with each end face of said output shaft having a series of radially spaced serrations thereon.

21. The drive mechanism according to claim 14, further including a cover extending about and enclosing the base, the power source and the intermeshing gear sets while permitting access to opposed ends of said output shaft.

* * * * *